US007575307B2

(12) United States Patent
Sanada

(10) Patent No.: US 7,575,307 B2
(45) Date of Patent: Aug. 18, 2009

(54) LIQUID EJECTION HEAD, METHOD OF MANUFACTURING SAME, AND IMAGE FORMING APPARATUS

(75) Inventor: Kazuo Sanada, Kanagawa (JP)

(73) Assignee: Fujifilm Corp., Tokyo (JP)

( * ) Notice: Subject to any disclaimer, the term of this patent is extended or adjusted under 35 U.S.C. 154(b) by 423 days.

(21) Appl. No.: 11/373,132

(22) Filed: Mar. 13, 2006

(65) Prior Publication Data

US 2006/0203043 A1 Sep. 14, 2006

(30) Foreign Application Priority Data

Mar. 14, 2005 (JP) ..... 2005-071588

(51) Int. Cl.
*B41J 2/045* (2006.01)

(52) U.S. Cl. ..... 347/70

(58) Field of Classification Search ..... 347/68–72
See application file for complete search history.

(56) References Cited

U.S. PATENT DOCUMENTS 4,383,264 A * 5/1983 Lewis ..... 347/68
5,581,861 A * 12/1996 Lee et al. ..... 29/25.35

FOREIGN PATENT DOCUMENTS

JP 2004-237676 A 8/2004

* cited by examiner

*Primary Examiner*—Stephen D Meier
*Assistant Examiner*—Geoffrey Mruk
(74) *Attorney, Agent, or Firm*—Birch, Stewart, Kolasch & Birch, LLP

(57) ABSTRACT

The liquid ejection head comprises: a pressure chamber which is connected to an ejection port ejecting liquid; an actuator which is disposed inside the pressure chamber and deforms due to prescribed driving; a holding member which holds the actuator; and a shielding member which, when a surface of the actuator held by the holding member is a bottom face, seals off the liquid inside the pressure chamber from side faces of the actuator, while allowing an upper surface of the actuator to make contact with the liquid inside the pressure chamber.

8 Claims, 7 Drawing Sheets

LIQUID EJECTION HEAD, METHOD OF MANUFACTURING SAME, AND IMAGE FORMING APPARATUS

BACKGROUND OF THE INVENTION

1. Field of the Invention

The present invention relates to a liquid ejection head, a method of manufacturing same, and an image forming apparatus, and more particularly, to a liquid ejection head, method of manufacturing same, and an image forming apparatus, whereby liquid is ejected from ejection ports by changing the volume of pressure chambers connected to the ejection ports.

2. Description of the Related Art

An image forming apparatus is known which forms images on a recording medium, such as paper, by ejecting ink from nozzles toward the recording medium, while moving an ink ejection head having an arrangement of a plurality of nozzles and the recording medium, relatively to each other.

A known ink ejection head mounted in an image forming apparatus of this kind is a piezo type ink ejection head, in which ink is supplied to pressure chambers connected to nozzles, and the volume of the pressure chambers is changed, thereby causing the ink inside the pressure chambers to be ejected from the nozzles, by applying a drive signal corresponding to the image data to piezoelectric elements which are installed through a diaphragm plate on the outer side of the pressure chambers.

On the other hand, an ink ejection head fitted with unimorph type piezoelectric elements is also known, in which a portion of the inner walls of the pressure chambers (individual liquid chambers) is formed by a vibrating unit having a diaphragm, and piezoelectric elements are disposed on the side of this vibrating unit that is adjacent to the pressure chambers (see Japanese Patent Application Publication No. 2004-237676). Japanese Patent Application Publication No. 2004-237676 also describes setting the thickness of the diaphragm by means of the SOI (silicon on insulator) layer thickness of the SOI substrate, in order to ensure that the diaphragm has an accurate thickness.

However, as shown in FIG. 10, in an ink ejection head according to the related art, the upper surface and side faces of the piezoelectric element 60, apart from the fixing surface (bottom surface) where it is fixed to the diaphragm 56, make contact with the liquid inside the pressure chamber 52, through a passivation film (protective film) 964 having ink resisting properties, and the like. Therefore, the change in the volume of the pressure chamber 52 induced by the movement 91 of the upper surface of the piezoelectric element 60 and the change in the volume of the pressure chamber 52 induced by the movement 92 of the side faces of the piezoelectric element 60 counteract each other, and the volume of the pressure chamber 52 cannot be made to change efficiently with respect to the voltage applied to the piezoelectric element 60. Therefore, a problem arises in that ink cannot be ejected from the nozzle 51 with good efficiency.

SUMMARY OF THE INVENTION

The present invention has been contrived in view of the foregoing circumstances, an object thereof being to provide a liquid ejection head, a method of manufacturing same, and an image forming apparatus, whereby the liquid can be ejected efficiently by changing the volume of the pressure chamber efficiently.

In order to attain the aforementioned object, the present invention is directed to a liquid ejection head, comprising: a pressure chamber which is connected to an ejection port ejecting liquid; an actuator which is disposed inside the pressure chamber and deforms due to prescribed driving; a holding member which holds the actuator; and a shielding member which, when a surface of the actuator held by the holding member is a bottom face, seals off the liquid inside the pressure chamber from side faces of the actuator, while allowing an upper surface of the actuator to make contact with the liquid inside the pressure chamber.

According to the present invention, the upper surface of the actuator makes contact with the liquid inside the pressure chamber and the movement of the upper surface of the actuator contributes to changing the volume of the pressure chamber, whereas the liquid inside the pressure chamber is shut off from the side faces of the actuator. Therefore, the change in the volume of the pressure chamber is not reduced by the movement of the side faces of the actuator, and hence the volume of the pressure chamber can be changed efficiently in response to the driving of the actuator, and liquid can be ejected with good efficiency.

Preferably, the shielding member covers the side faces of the actuator and deforms in accordance with movement of the side faces of the actuator. According to this, the liquid inside the pressure chamber is shut off from the side faces of the actuator by the shielding member which covers the side faces of the actuator, and therefore, the volume of the pressure chamber can be changed efficiently in response to the driving of the actuator.

Preferably, spaces are formed between the shielding member and the side faces of the actuator, and movement of the side faces of the actuator is absorbed by the spaces without contributing to changing volume of the pressure chamber. According to this, the movement of the side faces of the actuators is absorbed by the spaces created between the shielding member and the side faces of the actuators, and therefore the volume of the pressure chamber can be changed efficiently in response to the driving of the actuator.

Preferably, the shielding member is constituted by a partition wall of the pressure chamber.

Preferably, the space between at least an outer perimeter section of the upper face of the actuator, and the partition wall, is sealed.

Preferably, the holding member is a diaphragm which vibrates in a thickness direction of the actuator due to movement of the actuator in a direction perpendicular to the thickness direction thereof.

According to the present invention, since the diaphragm vibrates in the thickness direction of the actuator due to the movement of the actuator in a direction perpendicular to the thickness direction of the actuator, and the volume of the pressure chamber is changed by means of the upper surface of the actuator, in accordance with the vibration of the diaphragm, then the volume of the pressure chamber can be changed efficiently in response to driving of the actuator, and liquid can be ejected with good efficiency.

In order to attain the aforementioned object, the present invention is also directed to an image forming apparatus, comprising the above-described liquid ejection head, the image forming apparatus forming an image on a prescribed recording medium by moving the liquid ejection head and the recording medium relatively to each other.

In order to attain the aforementioned object, the present invention is also directed to a method of manufacturing a liquid ejection head comprising: a pressure chamber which is connected to an ejection port ejecting liquid; an actuator which is disposed inside the pressure chamber and deforms due to prescribed driving; and a holding member which holds the actuator, the method comprising the steps of: disposing the actuator on the holding member; and disposing an upper surface of the actuator inside the pressure chamber, and forming a partition which seals off the liquid inside the pressure chamber from side faces of the actuator, when a surface of the actuator held by the holding member is a bottom face.

According to the present invention, it is possible to change the volume of the pressure chamber efficiently, and hence to eject liquid efficiently.

BRIEF DESCRIPTION OF THE DRAWINGS

The nature of this invention, as well as other objects and advantages thereof, will be explained in the following with reference to the accompanying drawings, in which like reference characters designate the same or similar parts throughout the figures and wherein.

DETAILED DESCRIPTION OF THE PREFERRED EMBODIMENTS

Embodiment of General Composition of Image Forming Apparatus

Figure 1:
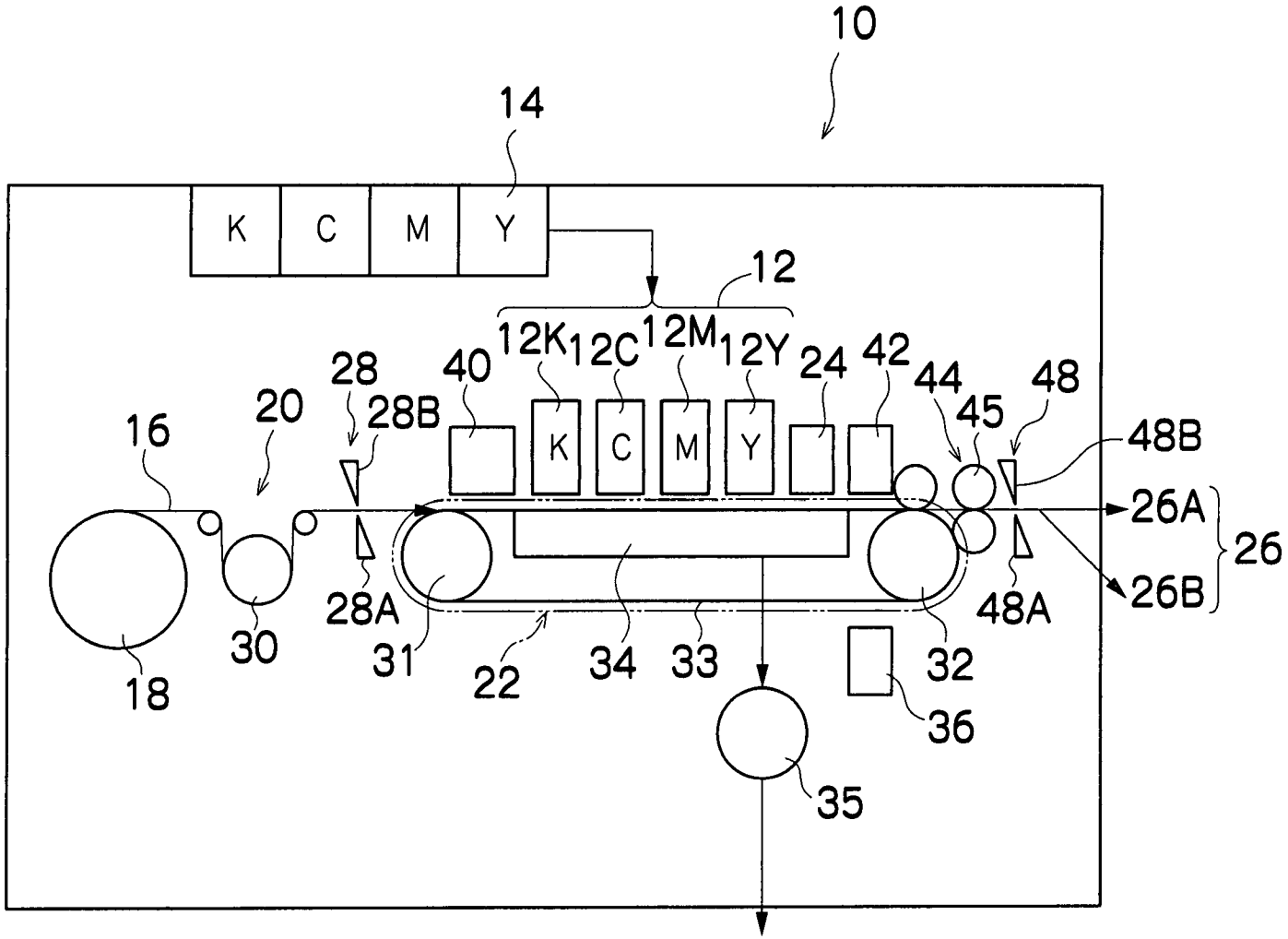
FIG. 1 is a general schematic drawing showing one embodiment of the general composition of an image forming apparatus having a liquid ejection head according to the present invention.

FIG. 1 is a general schematic drawing showing one embodiment of the general composition of an image forming apparatus according to the present invention.

As shown in FIG. 1, the image forming apparatus 10 comprises: an ink ejection unit 12 having a plurality of ink ejection heads 12K, 12C, 12M, and 12Y for respective ink colors; an ink storing and loading unit 14 for storing inks to be supplied to the ink ejection heads 12K, 12C, 12M, and 12Y; a paper supply unit 18 for supplying recording paper 16; a decurling unit 20 for removing curl in the recording paper 16; a suction belt conveyance unit 22 disposed facing the nozzle face (ink droplet ejection face) of the ink ejection unit 12, for conveying the recording paper 16 while keeping the recording paper 16 flat; a print determination unit 24 for reading the result of the printing produced by the ink ejection unit 12; and a paper output unit 26 for outputting printed recording paper to the exterior.

In FIG. 1, a supply of rolled paper (continuous paper) is displayed as one embodiment of the paper supply unit 18, but it is also possible to use a supply unit which supplies cut paper that has been cut previously into sheets. In a case where rolled paper is used, a cutter 28 is provided, as shown in FIG. 1. The cutter 28 comprises a fixed blade 28A and a circular blade 28B which moves along this fixed blade 28A. The recording paper 16 delivered from the paper supply unit 18 generally retains curl. In order to remove this curl, heat is applied to the recording paper 16 in the decurling unit 20 by a heating drum 30 in the direction opposite to the direction of the curl. After decurling, the cut recording paper 16 is delivered to the suction belt conveyance unit 22.

The suction belt conveyance unit 22 has a configuration in which an endless belt 33 is set around rollers 31 and 32 so that the portion of the endless belt 33 facing at least the nozzle face of the ink ejection unit 12 and the sensor face of the print determination unit 24 forms a plane (flat plane). The belt 33 has a width that is greater than the width of the recording paper 16, and a plurality of suction apertures (not shown) are formed on the belt surface. A suction chamber 34 is disposed in a position facing the sensor surface of the print determination unit 24 and the nozzle surface of the ink ejection unit 12 on the interior side of the belt 33, which is set around the rollers 31 and 32, as shown in FIG. 1. The suction chamber 34 provides suction with a fan 35 to generate a negative pressure, and the recording paper 16 on the belt is held by suction. The belt 33 is driven in the clockwise direction in FIG. 1 by the motive force of a motor (not shown) being transmitted to at least one of the rollers 31 and 32, which the belt 33 is set around, and the recording paper 16 held on the belt 33 is conveyed from left to right in FIG. 1. Since ink adheres to the belt 33 when a marginless print job or the like is performed, a belt-cleaning unit 36 is disposed in a predetermined position (a suitable position outside the printing area) on the exterior side of the belt 33. A heating fan 40 is disposed on the upstream side of the ink ejection unit 12 in the conveyance pathway formed by the suction belt conveyance unit 22. The heating fan 40 blows heated air onto the recording paper 16 to heat the recording paper 16 immediately before printing so that the ink deposited on the recording paper 16 dries more easily.

The ink ejection unit 12 is a so-called "full line head" in which a line head having a length corresponding to the maximum paper width is arranged in a direction (main scanning direction) that is perpendicular to the paper conveyance direction (sub-scanning direction). More specifically, respective ink ejection heads 12K, 12C, 12M and 12Y each have a plurality of nozzles (ejection ports) arranged through a length exceeding at least one edge of the maximum size of recording paper 16 intended for use with the image forming apparatus 10.

The ink ejection heads 12K, 12C, 12M, 12Y corresponding to respective ink colors are disposed in the order, black (K), cyan (C), magenta (M) and yellow (Y), from the upstream side (left-hand side in FIG. 1), following the direction of conveyance of the recording paper 16 (the paper conveyance direction). A color print can be formed on the recording paper 16 by ejecting the inks from the ink ejection heads 12K, 12C, 12M, and 12Y, respectively, onto the recording paper 16, while conveying the recording paper 16. The ink ejection unit 12, in which the full-line heads covering the entire width of the paper are thus provided for the respective ink colors, can record an image over the entire surface of the recording paper 16 by performing the action of moving the recording paper 16 and the ink ejection unit 12 relatively to each other in the paper conveyance direction (sub-scanning direction) just once (in other words, by means of a single sub-scan). Higher-speed printing is thereby made possible and productivity can be improved in comparison with a shuttle type head configuration in which an ink ejection head moves reciprocally in a direction (main scanning direction) which is perpendicular to the paper conveyance direction (sub-scanning direction).

Here, the terms main scanning direction and sub-scanning direction are used in the following senses. More specifically, in a full-line head comprising rows of nozzles that have a length corresponding to the entire width of the recording paper, "main scanning" is defined as printing one line (a line formed of a row of dots, or a line formed of a plurality of rows of dots) in the breadthways direction of the recording paper (the direction perpendicular to the conveyance direction of the recording paper) by driving the nozzles in one of the following ways: (1) simultaneously driving all the nozzles; (2) sequentially driving the nozzles from one side toward the other; and (3) dividing the nozzles into blocks and sequentially driving the blocks of the nozzles from one side toward the other. The direction indicated by one line recorded by a main scanning action (the lengthwise direction of the band-shaped region thus recorded) is called the "main scanning direction".

On the other hand, "sub-scanning" is defined as to repeatedly perform printing of one line (a line formed of a row of dots, or a line formed of a plurality of rows of dots) formed by the main scanning, while moving the full-line head and the recording paper relatively to each other. The direction in which sub-scanning is performed is called the sub-scanning direction. Consequently, the conveyance direction of the reference point is the sub-scanning direction and the direction perpendicular to same is called the main scanning direction.

Although a configuration with the four standard colors, K, C, M and Y, is described in the present embodiment, the combinations of the ink colors and the number of colors are not limited to those of the present embodiment, and light and/or dark inks can be added as required. For example, a configuration is possible in which ink ejection heads for ejecting light-colored inks such as light cyan and light magenta are added.

As shown in FIG. 1, the ink storing and loading unit 14 has tanks for storing inks of the colors corresponding to the respective ink ejection heads 12K, 12C, 12M and 12Y, and each tank is connected to a respective ink ejection head 12K, 12C, 12M, 12Y, through a tube channel (not shown).

The print determination unit 24 has an image sensor (line sensor) for capturing an image of the ink-droplet deposition result of the ink ejection unit 12, and functions as a device to check for ejection defects such as clogs of the nozzles in the ink ejection unit 12 from the ink-droplet deposition results evaluated by the image sensor.

A post-drying unit 42 is disposed following the print determination unit 24. The post-drying unit 42 is a device to dry the printed image surface, and includes a heating fan, for example. A heating/pressurizing unit 44 is disposed following the post-drying unit 42. The heating/pressurizing unit 44 is a device to control the glossiness of the image surface, and the image surface is pressed with a pressure roller 45 having a predetermined uneven surface shape while the image surface is heated, and the uneven shape is transferred to the image surface. The printed matter generated is outputted from the paper output unit 26. In the inkjet recording apparatus 10, a sorting device (not shown) is provided for switching the outputting pathways in order to sort the printed matter with the target print and the printed matter with the test print, and to send them to paper output units 26A and 26B, respectively. When the target print and the test print are simultaneously formed in parallel on the same large sheet of paper, the test print portion is cut and separated by a cutter (second cutter) 48. The cutter 48 is disposed directly in front of the paper output unit 26, and is used for cutting the test print portion from the target print portion when a test print has been performed in the blank portion of the target print. The structure of the cutter 48 is the same as the first cutter 28 described above, and has a stationary blade 48A and a round blade 48B. Although not shown, the paper output unit 26A for the target prints is provided with a sorter for collecting prints according to print orders.

Since the ink ejection heads 12K, 12C, 12M and 12Y provided for the respective colors of ink shown in FIG. 1 all have a common structure, below, these heads are represented by an ink ejection head labeled with the reference numeral 50, and furthermore, the heads according to the respective embodiments are differentiated by using the reference numerals 50*a*, 50*b* and 50*c*.

Structure of Ink Ejection Head

The structure of the ink ejection head 50*a* according to the first embodiment of the present invention will be described with reference to FIGS. 2, 3 and 4.

Figure 2:
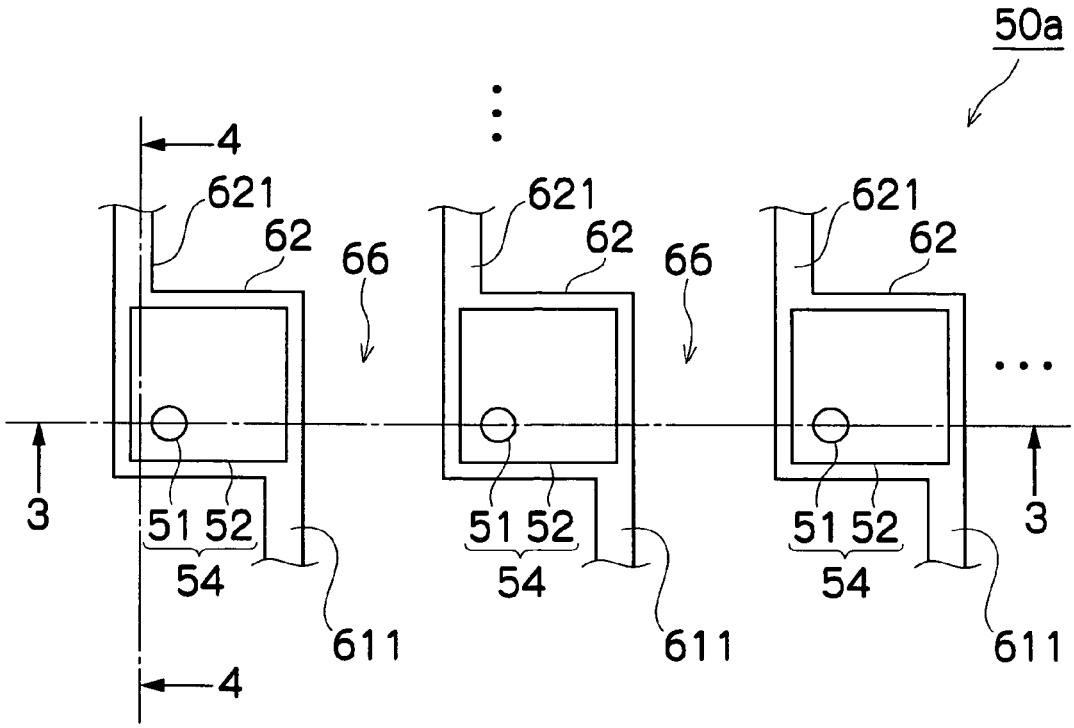
FIG. 2 is a plan view perspective diagram showing a portion of an embodiment of a liquid ejection head relating to the present embodiment.

FIG. 2 is a plan view perspective diagram showing a simplified view of a portion of the ink ejection head 50*a* according to the present embodiment. FIG. 3 shows a cross-sectional diagram along line 3-3 in FIG. 2, and FIG. 4 shows a cross-sectional diagram along line 4-4. Line 3-3 is a line following the main scanning direction, and line 4-4 is a line following the sub-scanning direction.

In FIG. 2, a plurality of pressure chamber units 54, each comprising a nozzle 51 which ejects ink, and a pressure chamber 52 connected to the nozzle 51, which applies pressure to the ink when ejecting ink from the nozzle 51, are arranged in a two-dimensional (or one-dimensional) configuration. More specifically, the plurality of nozzles 51 are arranged two-dimensionally (or one-dimensionally), and a plurality of pressure chambers 52 are similarly arranged two-dimensionally (or one-dimensionally). In FIG. 2, when the pressure chambers 52 are viewed from above, they have a substantially square planar shape, but the shape of the pressure chambers 52 is not limited in particular to a square shape of this kind.

In FIG. 2, reference numeral 62 is one electrode which constitutes a part of the piezoelectric actuator described below, and the other electrode is omitted from FIG. 2. The reference numerals 621 and 611 are assigned respectively to the wires connected to these electrodes. The electrodes and wires are described hereinafter.

Figure 3:
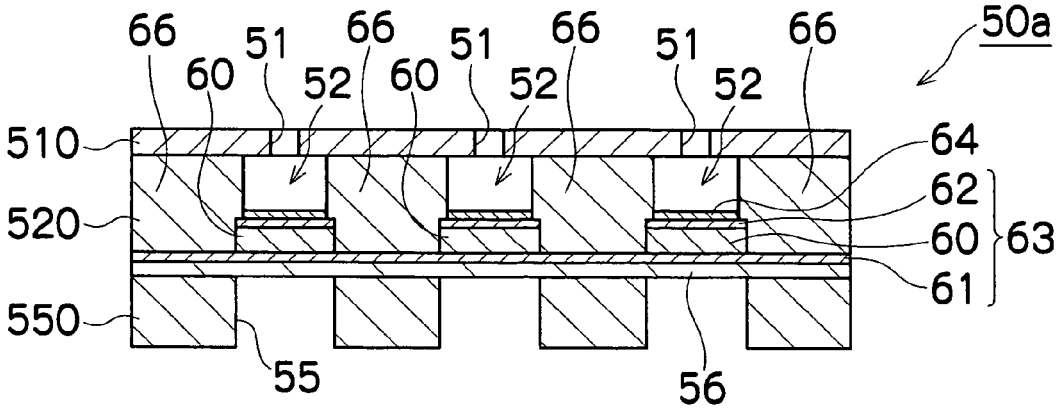
FIG. 3 is a cross-sectional diagram along line 3-3 in FIG. 2, showing a liquid ejection head according to a first embodiment.
Figure 4:
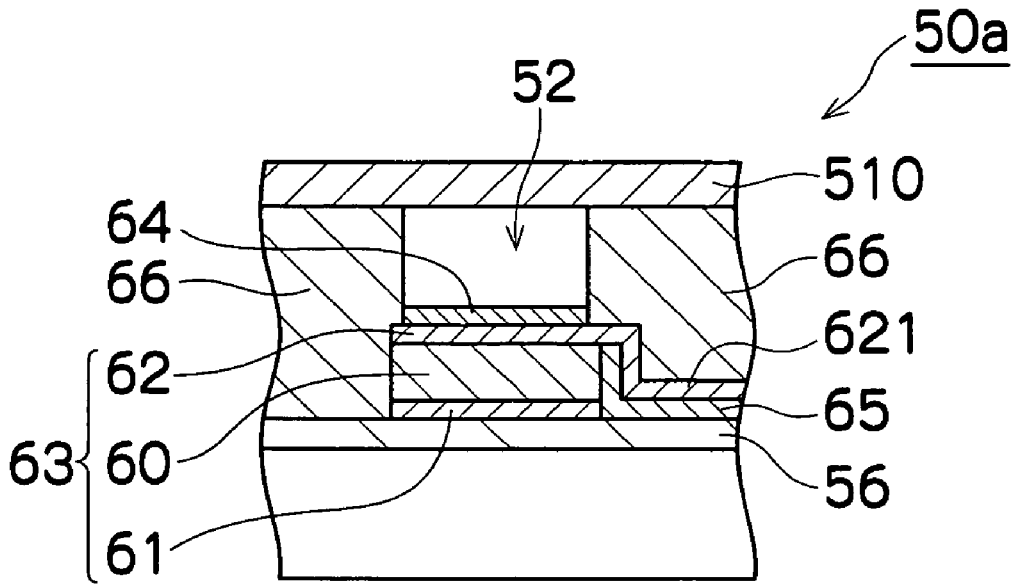
FIG. 4 is a cross-sectional diagram along line 4-4 in FIG. 2, showing a liquid ejection head according to the first embodiment.

In FIGS. 3 and 4, the nozzle plate 510 is a plate-shaped member in which a plurality of nozzles 51 are formed. A pressure chamber plate 520 is a plate-shaped member in which a plurality of pressure chambers 52 are formed. The pressure chambers 52 are separated from each other by means of partitions 66 which constitute a pressure chamber plate 520.

The piezoelectric actuators 63 of the present embodiment are unimorph type actuators, which are principally constituted by a single-plate piezoelectric element 60, and electrodes formed on either side of the piezoelectric element 60 in the thickness direction of the piezoelectric element 60 (lower electrode 61 and upper electrode 62).

In the present specification, the "piezoelectric elements" may also include elements known as "electrostrictive elements". The material of the piezoelectric elements 60 is, for example, PZT (lead titanate zirconate), barium titanate, or a relaxor material.

For the material of the electrodes 61 and 62, a metal or a conductive metal oxide is used.

FIG. 2 shows a case where the lower electrode 61 is formed commonly for the plurality of piezoelectric elements 60, but the invention is not limited to an embodiment where a common lower electrode is formed, and it may also be formed independently for each of the piezoelectric elements 60.

The piezoelectric actuators 63, each comprising a piezoelectric element 60 and electrodes 61 and 62, are held by a diaphragm 56. More specifically, one surface (the bottom face) of the piezoelectric actuator 63 is fixed to the diaphragm 56. In other words, the piezoelectric actuator 63 is supported on the substrate 550 (supporting member) through the diaphragm 56.

The piezoelectric element 60 is polarized in a particular direction and generates distortion (also called "displacement") in response to the electric field applied to the electrodes 61 and 62. In specific terms, the piezoelectric elements 60 are polarized in the thickness direction of the piezoelectric element 60 (also called the "vertical direction"), and when a prescribed application voltage is applied between the lower electrode 61 and the upper electrode 62, distortion occurs due to the electric field acting in the vertical direction between the electrodes 61 and 62, and the volume of the pressure chamber 52 is changed by this distortion.

Below, the displacement of the piezoelectric element 60 in the thickness direction thereof is called "vertical displacement", and the displacement of the piezoelectric element 60 in a direction perpendicular to the thickness direction is called "lateral displacement".

In the ink ejection head 50*a* according to the first embodiment, the partitions 66 cover the side faces of the respective piezoelectric elements 60 and have sufficient elasticity to expand and contract in the lateral direction in response to the lateral displacement of the piezoelectric element 60, and hence they each constitute a shielding member which shuts off the ink inside the pressure chamber 52 from the side faces of the piezoelectric element 60. The material of the partitions 66 is a material having lower rigidity than the piezoelectric elements 60. For example, partitions 66 made of resin are used for piezoelectric elements 60 made of PZT ceramics.

By means of partitions 66 of this kind, if the surface of the piezoelectric actuator 63 held on the diaphragm 56 is the bottom surface, then the upper surface of the piezoelectric actuator 63 makes contact with the ink inside the pressure chamber 52 and the movement of the upper surface of the piezoelectric actuator 63 contributes to changing the volume of the pressure chamber 52, whereas the ink inside the pressure chamber 52 is shielded from the side faces of the piezoelectric actuator 63 in such a manner that the change in the volume of the pressure chamber 52 is not reduced by the movement of the side faces of the piezoelectric actuator 63.

The diaphragm 56 vibrates due to the stress generated by the distortion of the piezoelectric element 60. In other words, it moves principally in the vertical direction, due to the lateral displacement of the piezoelectric element 60. By holding the piezoelectric actuator 63 on the diaphragm 56 in this way, the pressure chamber 52 in which the ink makes contact with the upper surface of the piezoelectric actuator 63 is made to change volume in a highly efficient manner.

A protective film 64 which protects the piezoelectric actuator 63 in such a manner that it does not make contact with the ink is provided on the upper surface of the piezoelectric actuator 63. This protective film 64 is made of resin, or the like. For this, it is possible to use the same resin as the partitions 66.

Furthermore, the upper electrode 62 of the piezoelectric actuator 63 is insulated from the lower electrode 61 by means of an insulating layer 65 as shown in FIG. 4.

Wires 621 and 622 are provided respectively so as to extend from the lower electrode 61 and the upper electrode 62 of the piezoelectric actuator 63, as shown in FIG. 2. The lower electrode 61 is earthed and an application voltage (drive signal) corresponding to the image data used for image formation is applied to the upper electrode 62. The shape and arrangement of the electrode wires 611 and 621 are not especially restricted to those shown in FIG. 2.

Furthermore, the ink supplied from the ink storing and loading unit 14 in FIG. 1 to the ink ejection head 50*a* is supplied to the plurality of pressure chambers 52. The flow channels for supplying ink to the plurality of pressure chambers 52 are omitted from FIGS. 2 to 4, but a common ink flow channel for the plurality of pressure chambers 52 is provided in the substrate 550, and independent ink flow channels from the common ink flow channel to the respective pressure chambers 52 are provided in the diaphragm 56 and partitions 66. A separate flow channel structure which is different to this embodiment may also be adopted.

Figure 5:
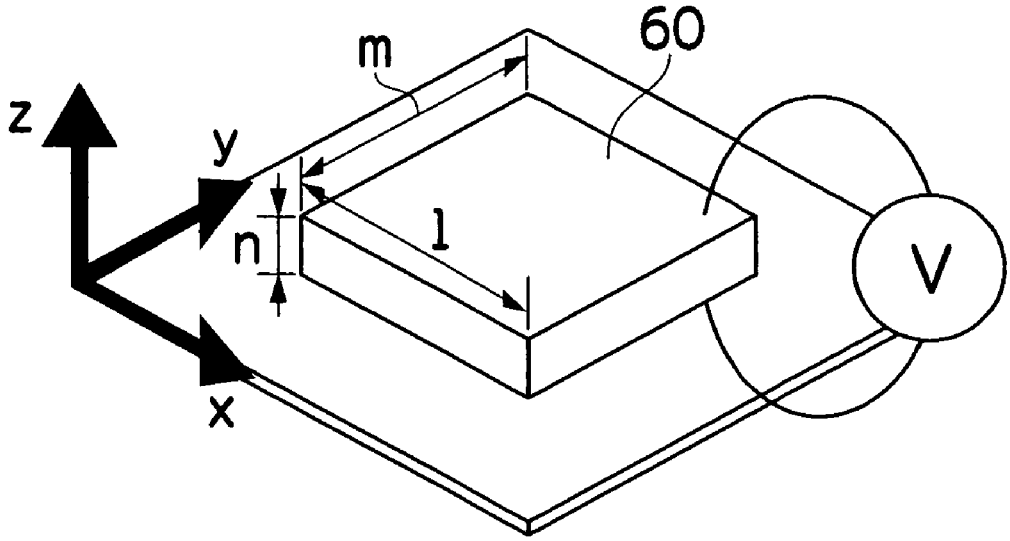
FIG. 5 is an illustrative diagram for describing the displacement of a piezoelectric element.
Figure 6:
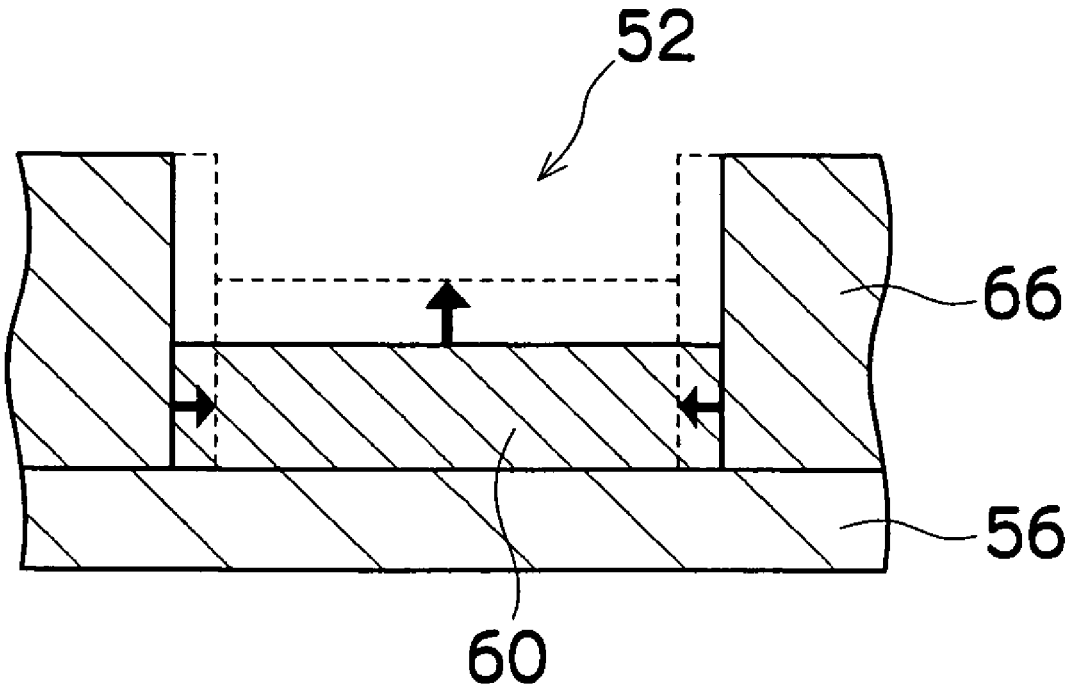
FIG. 6 is an illustrative diagram for describing the change in the volume of a pressure chamber.

FIGS. 5 and 6 are illustrative diagrams for describing the displacement of a piezoelectric element 60 and the change in the volume of the pressure chamber 52 corresponding to the voltage applied to the piezoelectric element 60. In FIGS. 5 and 6, the electrodes shown in FIGS. 2 to 4 (lower electrode 61 and upper electrode 62) are omitted in order to simplify the description and aid understanding of the present embodiment.

Here, taking the voltage applied to the piezoelectric element 60 (namely, the voltage applied between the electrodes 61 and 62 shown in FIGS. 2 to 4) to be V, the dimensions of the piezoelectric element 60 in the directions of the x, y, and z axes, to be l, m and n, and the amount of displacement in the directions of the x, y and z axes of the piezoelectric element 60, to be a, b and c, then the relationships between the applied voltage V, the dimensions l, m and n of the piezoelectric element 60, and the amounts of displacement a, b and c of the piezoelectric element 60, are expressed by the following formulas:

$$c/n=d_{33}\times V/n, \quad (1)$$

$$b/m=d_{31}\times V/n, \text{ and} \quad (2)$$

$$a/l=d_{31}\times V/n. \quad (3)$$

where $d_{33}$ is the piezoelectric strain coefficient in the so-called "33" direction, and $d_{31}$ is the piezoelectric strain coefficient in the so-called "31" direction. The axis of polarization of the piezoelectric element 60 is represented by "3" and the axis perpendicular to this axis is represented by "1". More specifically, $d_{33}$ is the ratio of displacement in the "vertical direction" in a case where an electric field (V/m) is applied in the same direction as the direction of polarization (vertical direction), and $d_{31}$ is the ratio of displacement in the "lateral direction" (the direction perpendicular to the thickness direction of the piezoelectric element 60) in the same conditions.

In the present embodiment, the piezoelectric element 60 is disposed inside the pressure chamber 52, and therefore the change in the volume of the pressure chamber 52 caused by the displacement of the piezoelectric element 60 in the vertical direction ("33" direction), is not cancelled out by the change in the volume of the pressure chamber 52 caused by the displacement of the piezoelectric element 60 in the lateral direction ("31" direction). Here, if it is supposed that the volume of the pressure chamber 52 changes only due to vertical displacement of the piezoelectric element 60, then the removed volume of the fluid (ink) inside the pressure chamber 52 when a voltage V is applied to the piezoelectric element 60 is expressed as $Vol_{33}$:

$$Vol_{33}=c\times l\times m=d_{33}\times l\times m\times V. \quad (5)$$

On the other hand, if the side faces of the piezoelectric element 60 also make contact with the ink inside the pressure chamber 52, as well as the upper surface of the piezoelectric element 60, as in the related art, then the change in the volume of the pressure chamber 52 caused by the vertical displacement of the piezoelectric element 60 is counteracted by the lateral displacement of the piezoelectric element 60. Consequently, in the related art, the removed volume of the fluid inside the pressure chamber 52 when a voltage V is applied to the piezoelectric element 60 is expressed as $Vol_{33+31}$:

$$Vol_{33+31}=a\times m\times n+b\times n\times l+c\times l\times m=(d_{33}+2\times d_{31})\times l\times m\times V. \quad (6)$$

Here, if $d_{33}$=600 (pm/V) and $d_{31}$=−250 (pm/V) are substituted as typical piezoelectric strain constants for a piezoelectric element having relatively high displacement properties, then the removed volume of the liquid according to the present embodiment, $Vol_{33}$, and the removed volume of the liquid according to the related art, $Vol_{33+31}$, are expressed as follows:

$$Vol_{33}=600\times l\times m\times V(\text{pm/V}), \text{ and} \quad (7)$$

$$Vol_{33+31}=(600-2\times 250)\times l\times m\times V=100\times l\times m\times V(\text{pm/V}). \quad (8)$$

In cases of this kind, the removed volume $Vol_{33}$ in the ink ejection head 50 according to the present embodiment is around six times larger than the removed volume $Vol_{33+31}$ in the ink ejection head in the related art.

Figure 10:
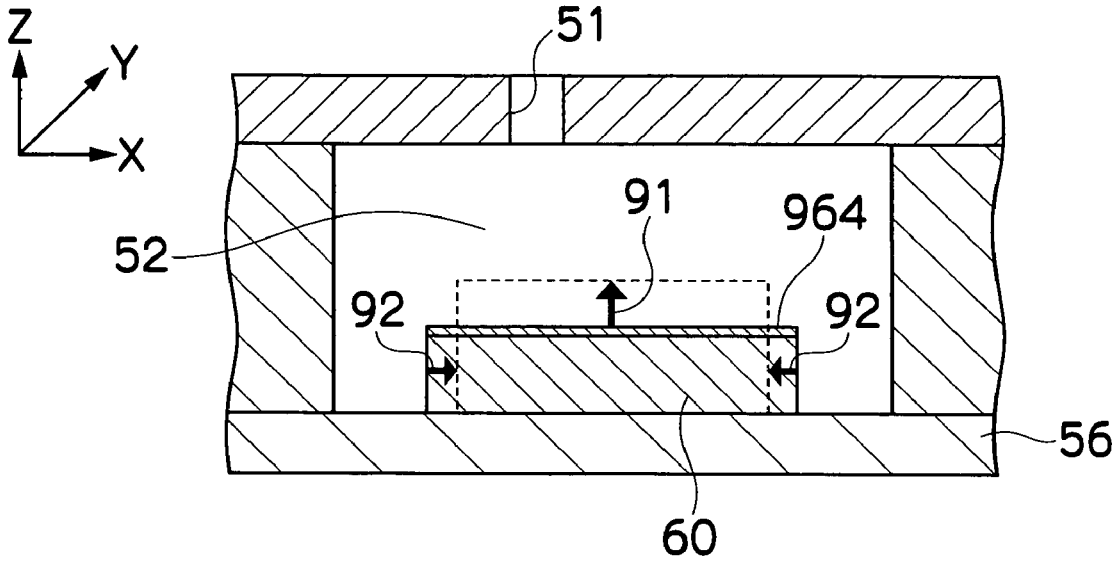
FIG.10 RELATED ART
FIG. 10 is an illustrative diagram for describing the change in the volume of a pressure chamber of a liquid ejection head in the related art.

The formulas given above are now applied to the ink ejection head in the related art shown in FIG. 10. The amount of displacement of the upper surface of the piezoelectric element 60 corresponds to "c" in Formula 1, and therefore $c=d_{33}\times V$. Furthermore, the amount of displacement of the side faces of the piezoelectric element 60 corresponds to "a" in Formula 3, and therefore $a/l=d_{31}\times V/n$. Here, "l" is the length of the piezoelectric element 60 in the lengthwise direction, and "n" is the height of the piezoelectric element 60. Consequently, in the ink ejection head in the related art shown in FIG. 10, the overall displacement volume of the pressure chamber 52 is given by Formula 5 as $(d_{33}+2\times d_{31})\times$"voltage V"×"area of upper surface". In other words, compared to the ink ejection head 50 according to the present embodiment, there is a loss in ink ejection corresponding to $2\times d_{31}\times$"voltage V"×"area of upper surface". In the ink ejection head in the related art shown in FIG. 10, when using the vertical displacement of the piezoelectric element 60, the change in the volume of the pressure chamber 52 is counteracted by the effects of the simultaneous displacement of the piezoelectric element 60 in the lateral direction.

In the ink ejection head 50 according to the present embodiment, as shown in FIGS. 2 to 4, the ink inside the pressure chambers 52 is shut off from the side faces of the piezoelectric elements 60 by partitions 66, and hence there is no occurrence of canceling out of the volume change in the pressure chambers 52, which occurs in the related art when the volume change of a pressure chamber 52 based on the vertical displacement of the piezoelectric element 60 is counteracted by the volume change of the pressure chamber 52 based on the lateral displacement of the piezoelectric element 60. Therefore, the volume of the pressure chamber 52 can be changed efficiently, and consequently, ink can be ejected in an efficient manner.

One embodiment of a manufacturing process for a liquid ejection head 50 according to the present invention is now described with reference to FIGS. 7A to 7G.

Figure 7A:
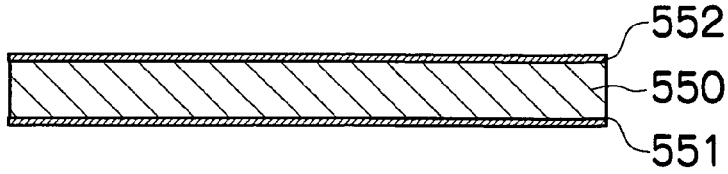
FIGS. 7A to 7G are illustrative diagrams for describing an embodiment of a manufacturing process for a liquid ejection head according to the first embodiment.

As shown in FIG. 7A, firstly, a substrate 550 made of silicon of a thickness of approximately 600 μm is prepared, and silica ($SiO_2$) layers 551 and 552 approximately 0.2 μm thick are formed on either surface of the substrate 550.

Figure 7B:
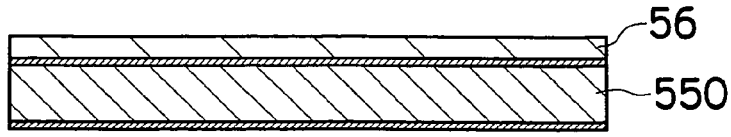

Thereupon, as shown in FIG. 7B, a diaphragm 56 made of silicon and having an approximate thickness of 5 μm is formed on one surface of the substrate 550.

Figure 7C:
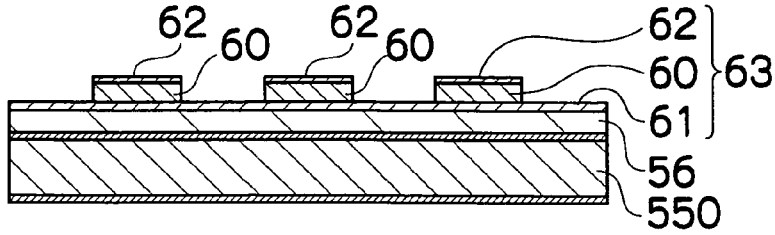

Thereupon, as shown in FIG. 7C, a lower electrode layer 61 made of platinum (Pt) and having an approximate thickness of 0.5 μm is formed on the diaphragm 56. A piezoelectric film made of ceramic PZT having a thickness of approximately 10 μm is formed by an aerosol deposition, sputtering or sol-gel technique, or the like, onto the lower electrode layer 61, and is then annealed at around 650° C. An upper electrode layer made of Pt and having an approximate thickness of 0.5 μm is then formed by sputtering, or the like, on the piezoelectric film, and is subsequently patterned by dry-etching or sandblasting to form piezoelectric elements 60 and upper electrodes 62. The piezoelectric elements 60 each have a width of approximately 30 μm and a height of approximately 20 μm.

Figure 7D:
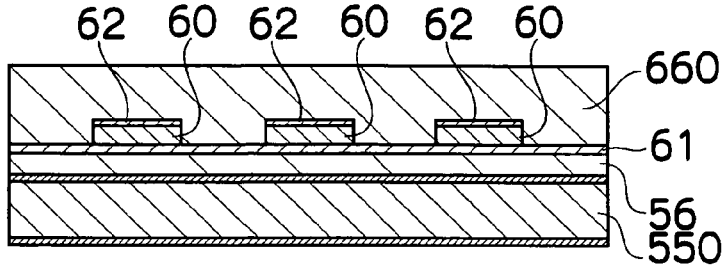
Figure 7E:
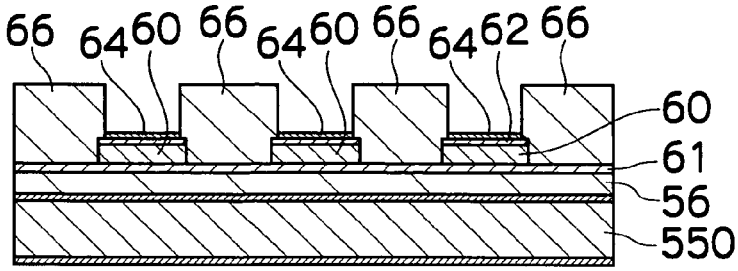

Next, as shown in FIG. 7D, a partition layer 660 made of resin and having an approximate layer thickness of 50 μm is formed by spin coating, and then patterned by etching, as shown in FIG. 7E, to form partitions 66. The width of the partitions 66 is approximately 19 μm, and the width of the flow channels (the width of the grooves which are subsequently to form pressure chambers 52) is made to be approximately 25 μm.

The resin used as the material of the partitions 66 has lower rigidity than the piezoelectric elements 60, and sufficient elasticity to deform in response to the displacement of the piezoelectric element 60 in the lateral direction. For example, a resin such as an epoxy resin, polyimide resin, acrylic resin, silicon resin, or the like, is used.

A protective layer 64 made of resin having an approximate thickness of 0.5 μm is formed on the exposed portions of the piezoelectric elements 60 (on top of the upper electrodes 62). The resin used as the material of the protective layer 64 may be the same resin that is used for the partitions 66, or it may be a different resin.

Figure 7F:
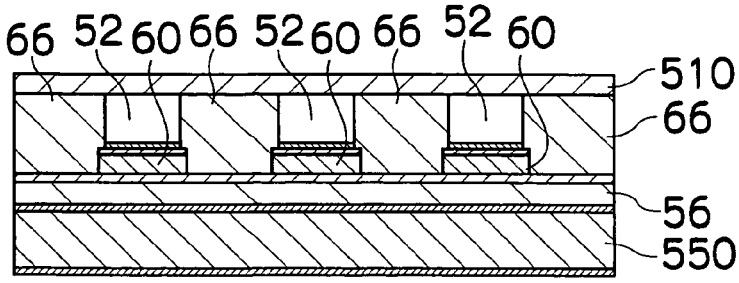

Thereupon, as shown in FIG. 7F, a nozzle plate 510 having a thickness of approximately 20 μm is formed by lamination, or the like.

Figure 7G:
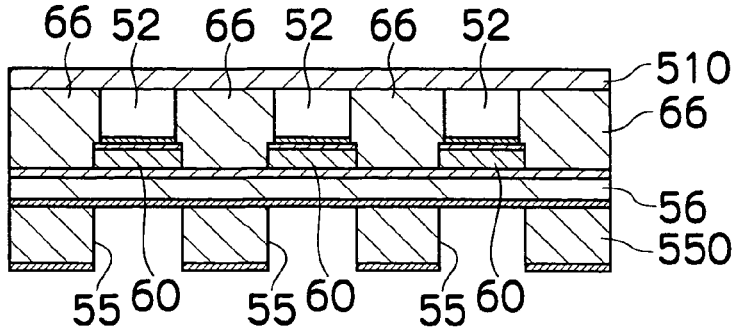

Next, as shown in FIG. 7G, the silica layer on the under side of the SOI substrate 550 is patterned and wet-etched, to form grooves 55.

When nozzles 51 are also formed in the nozzle plate 510 by dry etching, an ink ejection head 50*a* as shown in FIG. 2 to FIG. 4 is achieved.

The pressure chamber plate 520 is not limited to one formed on the piezoelectric actuators 63 by a photofabrication method, and it is also possible to dispose a previously patterned pressure chamber plate 520 on top of the piezoelectric actuators 63.

Next, the structure of the ink ejection head 50*b* according to a second embodiment will be described principally with reference to FIG. 8.

Figure 8:
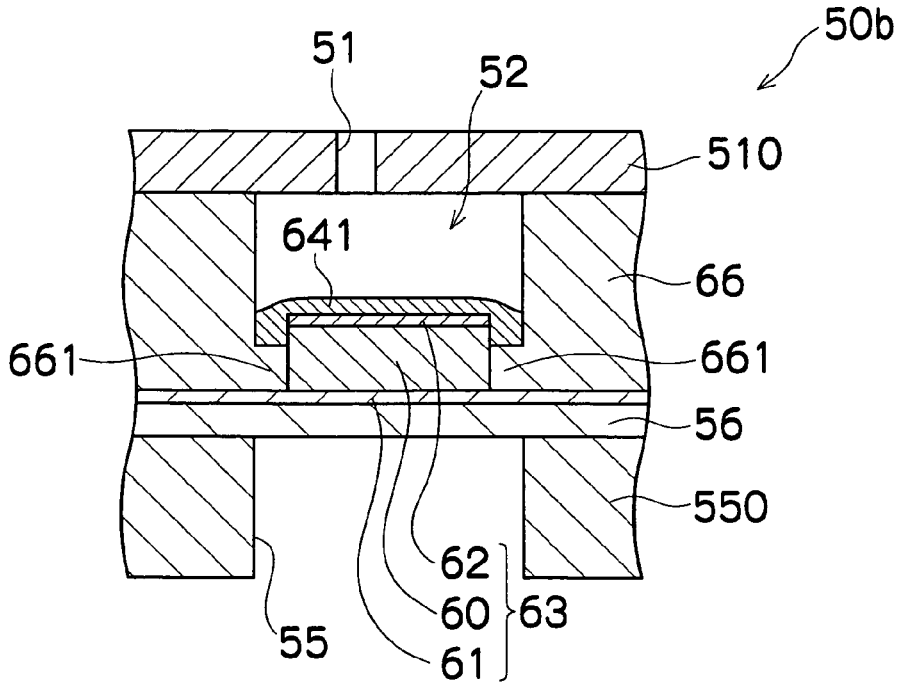
FIG. 8 is a cross-sectional view showing a liquid ejection head according to a second embodiment.

FIG. 8 is a cross-sectional diagram showing a cross-section of a portion of the ink ejection head 50*b* according to the second embodiment, taken along the main scanning direction. Constituent elements which are the same as those of the ink ejection head 50*a* according to the first embodiment shown in FIG. 2 to FIG. 4 are labeled with the same reference numerals.

The ink ejection head 50*b* according to the second embodiment differs from the ink ejection head 50*a* of the first embodiment in that, of the partitions 66, the junction sections 661 with the piezoelectric elements 60 and have a lower height than the piezoelectric elements 60. On the other hand, a protective layer 641 covers the height differential between the junction sections 661 of the partitions 66 and the piezoelectric element 60. In other words, the side faces of the piezoelectric element 60 are covered jointly by the junction sections 661 of the partitions 66 and the protective layer 641. Accordingly, the ink inside the pressure chamber 52 is shut off from the side faces of the piezoelectric elements 60.

The protective film 641 not only protects the upper electrode 62 of the piezoelectric actuator 63 from contact with the ink inside the pressure chamber 52, but also provides a seal which prevents ink from entering in between the outer perimeter (edges) of the upper surface of the piezoelectric actuator 63, and the partitions 66.

Furthermore, in the ink ejection head 50*b* according to the second embodiment, the partitions 66 deform freely in the lateral direction in response to lateral displacement of the side faces of the piezoelectric element 60, and the resistance of the partitions 66 with respect to displacement of the piezoelectric element 60 in the vertical direction is reduced to a minimum, thereby allowing the piezoelectric element 60 to be displaced freely in the vertical direction.

Figure 9:
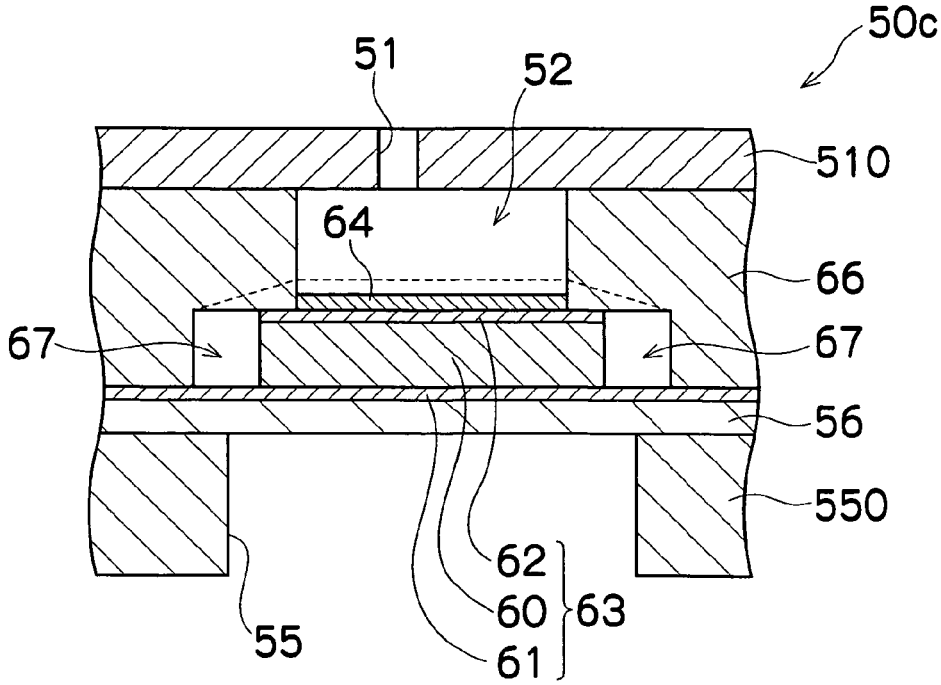
FIG. 9 is a cross-sectional view showing a liquid ejection head according to a third embodiment.

FIG. 9 is a cross-sectional diagram showing a cross-section of a portion of the ink ejection head 50*c* according to a third embodiment, taken along the main scanning direction. Constituent elements which are the same as those of the ink ejection head 50*a* according to the first embodiment shown in FIG. 2 to FIG. 4 are labeled with the same reference numerals.

In the ink ejection head 50*c* according to the third embodiment, in contrast to the ink ejection head 50*a* of the first embodiment, a space 67 is formed between each partition 66 and the side face of the piezoelectric element 60, and hence the movement of the side faces of the piezoelectric elements 60 is absorbed by the spaces 67, rather than contributing to changing the volume of the pressure chambers 52.

The protective film 64 not only protects the upper electrode 62 of the piezoelectric actuator 63 from contact with the ink inside the pressure chamber 52, but also provides a seal which prevents ink from entering in between the outer perimeter (edges) of the upper surface of the piezoelectric actuator 63, and the partitions 66, thereby preventing the in-flow of ink into the spaces 67.

The respective embodiments described above related to embodiments where protective layers 64 and 641 are provided to protect the electrodes 62, and the like, of the piezoelectric actuators 63 from contact with the ink inside the pressure chambers 52, but if there is no need to protect the electrodes or piezoelectric elements which form the piezoelectric actuators 63, due to the type of ink used, then the protective layers 64 and 641 may be omitted. Furthermore, as described in the third embodiment shown in FIG. 9, if spaces 67 are provided in between the partitions 66 and the piezoelectric elements 60, then it is necessary to protect the spaces 67 to prevent ink from entering into same, irrespective of whether or not measures are taken to prevent the piezoelectric actuators 63 from making contact with the liquid.

Furthermore, in the foregoing descriptions, the partitions 66 which separate the pressure chambers 52 from each other are described as members for shutting off the ink in the pressure chambers 52 from the side faces of the piezoelectric actuators 63 (shielding members), but the present invention also includes cases where shielding members are provided separately from the partitions 66, rather than using the partitions 66 as shielding members.

Furthermore, it is also possible to use the diaphragm 56 as one electrode (the common electrode) of the piezoelectric actuators 63.

Moreover, in the foregoing description, a diaphragm 56 is used as a member for holding the piezoelectric actuators 63 (holding member), but the present invention also includes cases where a member other than a diaphragm 56 holds the piezoelectric actuators 63. For example, it also includes cases where the piezoelectric actuators 63 are installed directly on a SOI substrate, without using providing a diaphragm 56.

Besides this, the present invention is not limited to the embodiments described in the embodiments, and various design modifications and improvements may be implemented without departing from the scope of the present invention.

It should be understood, however, that there is no intention to limit the invention to the specific forms disclosed, but on the contrary, the invention is to cover all modifications, alternate constructions and equivalents falling within the spirit and scope of the invention as expressed in the appended claims.

What is claimed is:

1. A liquid ejection head, comprising:

a pressure chamber which is connected to an ejection port through which liquid is ejected;

an actuator which is disposed inside the pressure chamber and deforms due to prescribed driving;

a holding member which holds a bottom face of the actuator; and a shielding member which seals off the liquid inside the pressure chamber from lateral faces of the actuator, while allowing only an upper face of the actuator to make contact with the liquid inside the pressure chamber.

2. The liquid ejection head as defined in claim 1, wherein the shielding member covers the lateral faces of the actuator and deforms in accordance with movement of the lateral faces of the actuator.

3. The liquid ejection head as defined in claim 1, wherein spaces are formed between the shielding member and the lateral faces of the actuator, and movement of the lateral faces of the actuator is absorbed by the spaces without contributing to changing volume of the pressure chamber.

4. The liquid ejection head as defined in claim 1, wherein the shielding member is constituted by a partition wall of the pressure chamber.

5. The liquid ejection head as defined in claim 4, wherein the space between at least an outer perimeter section of the upper face of the actuator, and the partition wall, is sealed.

6. The liquid ejection head as defined in claim 1, wherein the holding member is a diaphragm which vibrates in a thickness direction of the actuator due to movement of the actuator in a direction perpendicular to the thickness direction thereof.

7. An image forming apparatus, comprising the liquid ejection head as defined in claim 1, the image forming apparatus forming an image on a prescribed recording medium by moving the liquid ejection head and the recording medium relatively to each other.

8. The liquid ejection head as defined in claim 1, wherein the actuator is a piezoelectric actuator that is polarized in a vertical direction thereof by application of a voltage applied in the vertical direction, so that the actuator provides vertical displacement in a $d_{33}$ direction and lateral displacement in a $d_{31}$ direction.

* * * * *